US007228837B2

(12) United States Patent
Smith

(10) Patent No.: US 7,228,837 B2
(45) Date of Patent: Jun. 12, 2007

(54) MOTORCYCLE OIL FILTERING SYSTEM

(76) Inventor: Gerald J. Smith, 9941 SW. 50th Ave., Portland, OR (US) 97219

( * ) Notice: Subject to any disclaimer, the term of this patent is extended or adjusted under 35 U.S.C. 154(b) by 54 days.

(21) Appl. No.: 11/180,249

(22) Filed: Jul. 13, 2005

(65) Prior Publication Data

US 2007/0012279 A1 Jan. 18, 2007

(51) Int. Cl.
*F01M 11/03* (2006.01)

(52) U.S. Cl. ..... 123/196 R; 123/196 A; 184/6.24

(58) Field of Classification Search ..... 123/196 A, 123/196 R, 196 AB, 198 R; 184/6.24
See application file for complete search history.

(56) References Cited

U.S. PATENT DOCUMENTS 4,492,632 A * 1/1985 Mattson ..... 210/167.05
4,901,693 A * 2/1990 DeGrazia, Jr. ..... 123/196 S
5,298,158 A * 3/1994 Anderson ..... 210/167.04
6,811,686 B1 * 11/2004 Sorce ..... 210/167.06

* cited by examiner

*Primary Examiner*—Stephen K. Cronin
*Assistant Examiner*—Hyder Ali

(57) ABSTRACT

A filtering system provides an oil flow to a filter carried by a support offset from a down tube of a motorcycle frame. An engine mounted bracket directs oil flow to be filtered to a cap assembly which is attached to an oil conduit. A threaded tubular member of the cap assembly permits rotational positioning of the attached conduit end, and positioning of the conduit, to facilitate conduit passage past motorcycle components to the filter support.

5 Claims, 2 Drawing Sheets

MOTORCYCLE OIL FILTERING SYSTEM

BACKGROUND OF THE INVENTION

The present invention concerns the filtering of engine oil in motorcycle engines.

It is a common practice to locate a filter canister forwardly adjacent a motorcycle engine block between the block and rearward of the down tubes of the motorcycle flame. The clearance for such filter placement is minimal greatly complicating periodic replacement of the oil filter. As the filter is transversely disposed of the frame in a horizontal manner engine oil usually spills during a filter changing effort. In some motorcycles electrical components are located below the filter resulting in the components being contaminated. A further problem exists in that minimal clearance between the filter and motorcycle components prohibits or hinders the application of a filter wrench in most cases. Still further, the disposition of the oil filter forward of an engine cylinder reduces air flow therepast resulting in diminishing of the cooling effect.

SUMMARY OF THE PRESENT INVENTION

The present filtering system includes relocating an engine oil filter housing adjacent a motorcycle frame down tube with the filter being readily accessible for maintenance purposes as well as providing other benefits.

Installation of the present oil filtering system may include, utilization of an existing oil flow bracket on a motorcycle engine which heretofore supported an oil filter. A cap assembly of the present system on the bracket serves to direct unfiltered oil to a filter and subsequent return of filtered oil via conduit means to the engine block.

Objectives of the present filtering system include the locating of an oil filter on a motorcycle frame down tube to facilitate maintenance efforts and further partake of the cooling effect of an airflow therepast when under way; the provision of a motorcycle oil filtering system which may conveniently partake of some components of an original filtering system facilitating installation of the present system in a convenient, low cost manner; the provision of an engine oil filtering system resulting in the repositioning of the replaceable filter away from electrical components and other components subject to being contaminated by engine oil during a filter changing operation; the provision of an upright oil filter enabling pre-filling to present a "dry" engine start after an oil change.

DETAILED DESCRIPTION OF THE PREFERRED EMBODIMENTS

Figure 1:
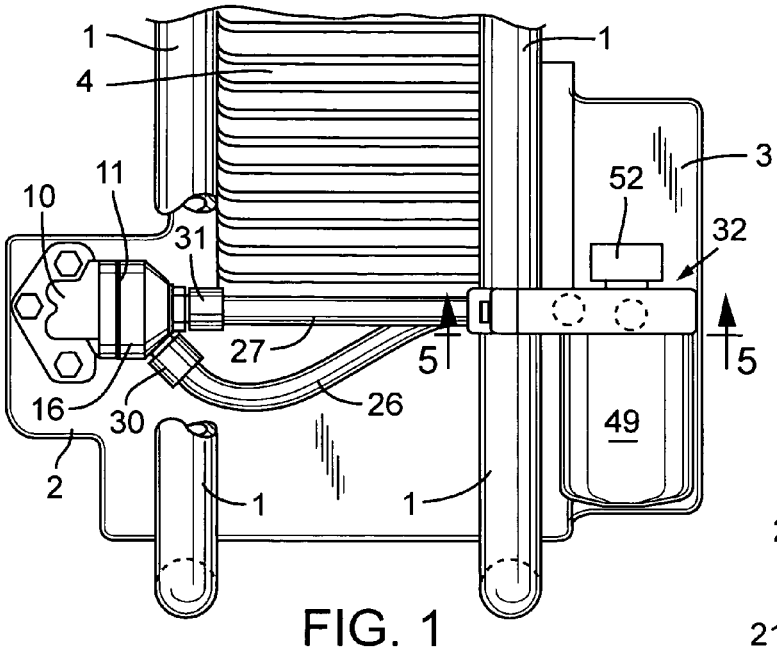
FIG. 1 is an elevational view of the forward portion of a motorcycle frame with a down tube segment removed for illustrative purposes.

With continuing attention to the drawings wherein applied reference numerals indicate parts similarly hereinafter identified, the reference numeral 1 indicates down tubes of a tubular motorcycle frame which additionally includes horizontal, rearwardly extending segments. The frame at its forward end supports a fork An engine block is indicated at 2 while a transmission case is at 3. An engine cylinder is at 4. The foregoing is intended to be a more or less general description of a typical motorcycle.

A filtering system bracket 10 in place on engine block 2 defines passageways for receiving unfiltered oil and subsequent reception of filtered oil for return to the engine block. An annular surface 11 on the bracket, in original use, served to form a seal with a resilient ring integral with a filter canister. The term filter includes a metal canister housing the filter proper.

Figure 3:
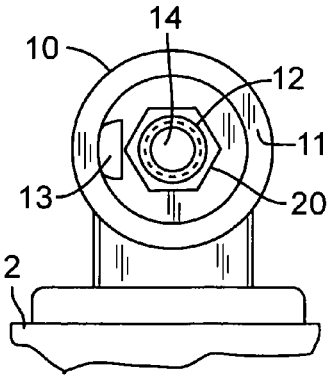
FIG. 3 is a vertical sectional view taken along line 3—3 of FIG. 2.

With attention to FIG. 3, bracket 10 includes an externally threaded fitting or union 12 and oil passageways at 13 and 14.

Figure 4:
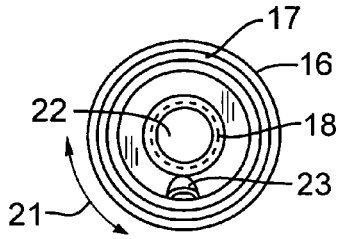
FIG. 4 is a vertical sectional view taken line 4—4 of FIG. 2.
Figure 2:
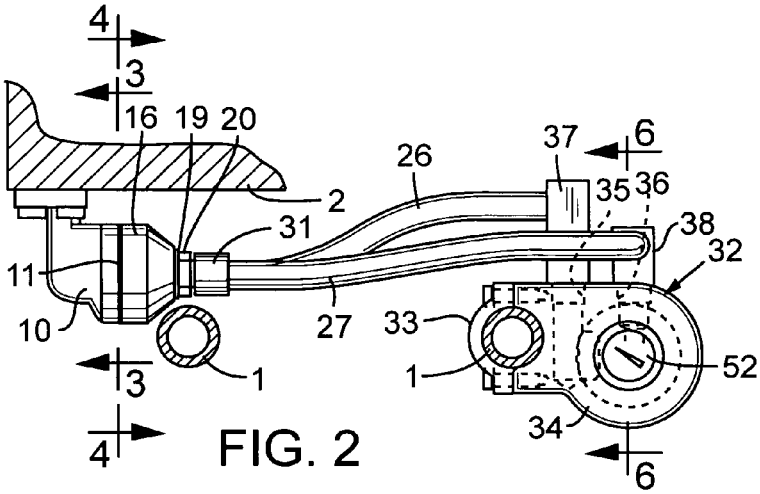
FIG. 2 is a plan view of FIG. 1.
Figure 7:
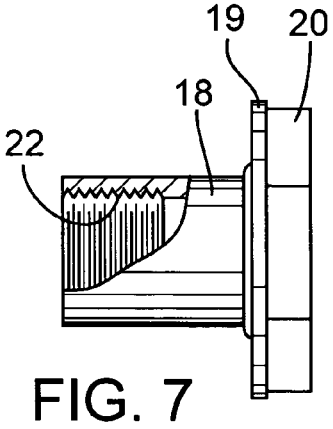
FIG. 7 is an elevational view of a cup assembly tubular member.

A cap assembly 16 of the present system is provided with a seal such as an O ring at 17 for abutment with bracket annular surface 11. With reference to FIGS. 4 and 7, internally threaded tubular member at 18 serves to mate with externally threaded union 12 on bracket 10 for retention of the cap on the bracket. A hex head 20 on member 18 permits tool application to assure fluid tight engagement of cap and bracket surfaces. In many installations of the present system it will be advantageous to be able to rotatably position the cap, per arrow 21, to permit installation of an attached hose (later described) to avoid conflict with adjacent motorcycle parts. A washer at 19 with an elastomeric sealant further assures leak free combination of cap and tubular member 18. Oil passageways are at 22 and 23. Passageway 23 is internally threaded for reception of a conduit fitting 30 while centrally disposed tubular member 18 is internally threaded at its exposed end for reception of a second oil conduit fitting 31. Hoses are at 26 and 27, each provided with suitable fittings at their respective ends.

Figure 5:
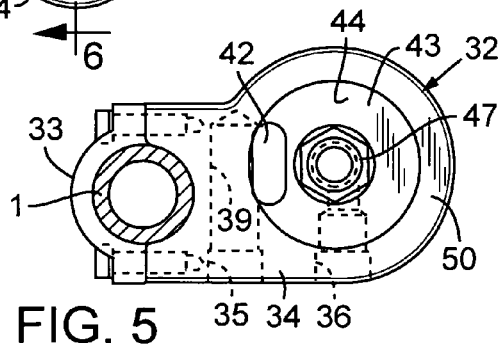
FIG. 5 is a view taken upwardly along line 5—5 of FIG. 1.
Figure 6:
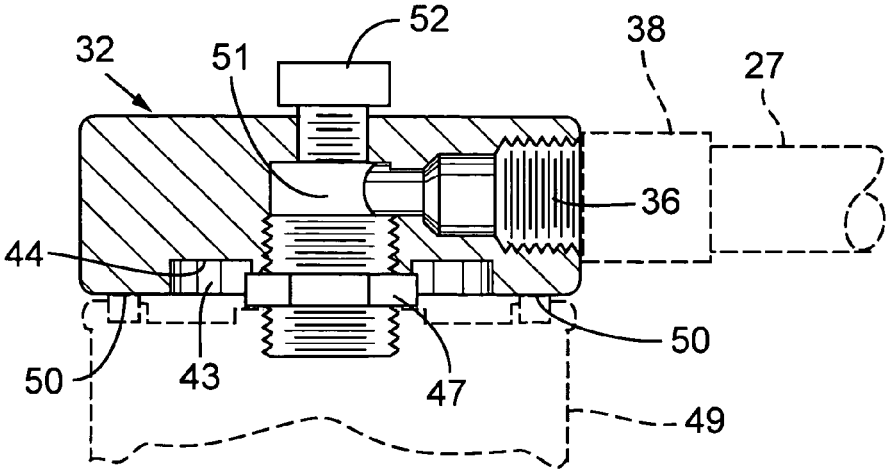
FIG. 6 is a sectional view taken along line 6—6 of FIG. 2.

With attention to FIGS. 5 and 6, a filter support is indicated generally at 32 having a clamp 33 which cooperates with the remainder of the support to clamp same to a frame down tube. A main body portion 34 of the holder is drilled and tapped at 35 and 36 to receive fittings 37–38 at the ends of conduits 26 and 27. A passageway 39 in the support terminates in an opening 42 in a recessed circular area 43 of the support. Wall surface 44 receives an externally threaded union type fitting 47 which receives a filter canister 49 typically internally threaded. The support includes a flat annular surface 50 for abutment with a resilient circular seal on the oil filter. A central open or core area of a filter will receive a flow of engine oil with the filtered oil thereafter entering holder passageway 51 and fitting 38 for return to bracket 10 and ultimately the engine block.

The outboard location of an engine oil filter, in addition to benefiting from the cooling of oil by an air stream during vehicle travel, prevents the holder and filter from interrupting or interfering with a direct airflow moving past an air cooled cylinder 4.

An oil pressure gauge is at 52.

Figure 8:
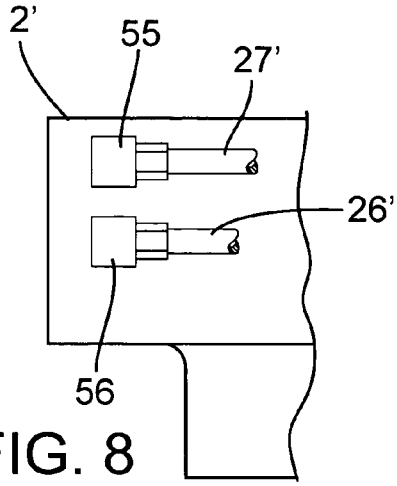
FIG. 8 is an elevational view of a modified system.

A modified oil filtering system enables installation of same on those motorcycles having an inadequate clearance between an engine block and a down tube to accept installation of bracket 10. Per FIG. 8, oil hoses 26' and 27' are coupled directly to an engine block at 2' by fittings 55 and 56.

While I have shown but one embodiment of the invention, it will be apparent to those skilled in the art that the invention may be embodied still otherwise without departing from the spirit and scope of the claimed invention.

I claim:

1. An engine oil filter system for a motorcycle having tubular frame members on which an engine is mounted and a pair of down tubes, said system including, an engine mounted bracket having oil inlet and outlet passageways, a cap assembly on said bracket and defining a first set of passageways, a support for an engine oil filter and having a clamp for engagement with one of the down tubes, a main body portion extending laterally outward of said one of said down tubes and in the air-stream when the motorcycle is moving, said support defining a second set of oil passageways, and conduits in communication with the cap passageways and said mounting support passageways for flows of unfiltered and filtered oil during engine operation.

2. The engine oil filter system claimed in claim 1 wherein said cap assembly includes a tubular member in threaded engagement with said engine mounted bracket, said cap assembly rotatably settable relative said engine mounted bracket enabling selective positioning of a passageway of said first set of passageways to enable routing of one of said conduits past adjacent parts of the motorcycle.

3. In combination, a support for an engine oil filter, a motorcycle frame including a a pair of down tubes, said support for the filter including clamping means for engagement with one of the down tubes and having a main body portion projecting laterally outward from the down tube for reception of the oil filter.

a bracket for installation on a motorcycle engine, a cap assembly on said bracket having multiple oil passageways, and oil conduit means in communication with said cap assembly and with said support serving an engine oil filter on the support.

4. The combination claimed in claim 3 wherein said cap assembly includes a tubular member in threaded engagement with said bracket and a cap rotatably positionable on said tubular member enabling positioning of one of said multiple oil passageways for communication with said conduit means.

5. In combination, a down tube segment of a motorcycle frame, a support for an oil filter including a main body, a clamp on said main body for engagement with the down tube segment, said main body defining multiple motor oil passageways directing oil flows to and from an oil filter in place on the main body, an oil pressure gauge on said main body, conduit means in communication with the passageways and with a source of oil to be filtered, and said main body of the support when clamped to said down tube segment projecting laterally from the down tube segment positioning an oil filter outboard of the down tube segment.

* * * * *